US005897387A

United States Patent [19]

Vallet et al.

[11] Patent Number: 5,897,387

[45] Date of Patent: Apr. 27, 1999

[54] ELECTRICAL WATERPROOF COUPLER SOCKET WITH PROTECTIVE FLAP

[75] Inventors: Jean-Michel Vallet, Marly La Ville; Pierre Willams, Nogent Sur Marne, both of France

[73] Assignee: Societe d'Exploitation des Procedes Marechal (SEPM) s.a., Cedex, France

[21] Appl. No.: 08/820,036

[22] Filed: Mar. 19, 1997

[30] Foreign Application Priority Data

Mar. 22, 1996 [FR] France ..... 96 03574

[51] Int. Cl.[6] ..... H01R 13/453

[52] U.S. Cl. ..... 439/145; 439/137

[58] Field of Search ..... 439/136, 139, 439/145, 137

[56] References Cited

U.S. PATENT DOCUMENTS

| | | | |
|---|---|---|---|
| 4,284,311 | 8/1981 | Forster et al. | 439/145 |
| 5,413,493 | 5/1995 | Hoffman | 439/188 |
| 5,478,249 | 12/1995 | Crestin | 439/138 |
| 5,478,250 | 12/1995 | Hoffman | 439/142 |

FOREIGN PATENT DOCUMENTS

| | | |
|---|---|---|
| 0619628 | 10/1994 | European Pat. Off. . |
| 95/0697 | 3/1995 | WIPO . |

*Primary Examiner*—Neil Abrams
*Attorney, Agent, or Firm*—Greenblum & Bernstein, P.L.C.

[57] ABSTRACT

Electrical waterproof coupler socket is provided with a body including housings containing contacts and openings for passage of opposing contacts of another device. A protective flap is translationally slidably mounted on the body and includes apertures arranged in a same number and manner as the openings of the body, and includes at least one blocking zone. The flap is slidable between at least one blocking position where the at least one blocking zone blocks the openings, and an opening position where the openings and apertures are superimposed, with the at least one blocking zone comprising a plane that is inclined towards the opposing surface of the flap from front-to-rear with respect to the direction in which the flap translates towards the opening position. The openings of the body are surrounded by bevelled edges comprising ridges, with a plane passing through the ridges being parallel to the inclined plane of the at least one blocking zone, so that the at least one blocking zone presses on the ridges in the blocking position. Seals can also be included on the body or on the flap or on both. Water-tightness is thereby ensured while allowing an easy sliding of the flap which does not remain permanently in contact with the edges during its sliding, but which presses perfectly thereon in the blocking position.

20 Claims, 5 Drawing Sheets

ELECTRICAL WATERPROOF COUPLER SOCKET WITH PROTECTIVE FLAP

BACKGROUND OF THE INVENTION

1. Field of the Invention

The present invention relates to an electrical waterproof coupler socket, especially to constitute one of the connection elements of a connector, such as a charging connector, for example, for an electric vehicle.

2. Background and Material Information

Commonly owned U.S. Pat. No. 5,478,249 and European Patent Application No. EP 0 619 628, the disclosures of which are incorporated by reference in their entirety herein, describe an electrical connector, and more particularly a charging connector for an electric vehicle, including a coupler socket and a connector outlet adapted for coupling and uncoupling in order to connect, or reciprocally to separate, the opposing contacts with which they are provided.

For safety purposes, the outlet and the coupler socket are provided with a protective member, such as a sliding flap for the coupler socket, to mask the contacts when at rest.

Depending on the conditions of use, the mere masking of the contacts of the coupler socket at rest can prove insufficient, and to further improve safety, it may be necessary to also ensure imperviousness, such as to the entrance of liquids, for example, water.

However, one major difficulty lies in the fact that translational elements are utilized, and it is therefore difficult to both ensure adequate imperviousness and limit the wear and tear without additionally hindering the sliding of the flap.

SUMMARY OF THE INVENTION

The present invention proposes an electrical coupler socket having a protective flap of the type as described above, and includes contacts that are arranged in housings of a body provided with openings for passage of the opposing contacts of another device. As many passage apertures are provided in the flap as the openings for passage of the opposing contacts, and the apertures are arranged in the same manner as these openings. The flap is translationally slidably mounted between at least one blocking position where zones thereof block the openings of the body and an opening position where such openings of the body and the apertures of the flap are superimposed. The surface of the flap facing the contacts has, on each blocking zone adapted to block one or more openings of the housings, a plane that is inclined towards the opposing surface of the flap and from front-to-rear with respect to the direction in which the flap translates towards its opening position. The openings of the housings are surrounded by bevelled edges structured and arranged so that planes containing the ridges of the edges are parallel to the inclined planes of the blocking zones of the flap, so that the blocking zones press properly on the ridges of the edges in the blocking position.

Thus, by the present invention, imperviousness can be ensured while allowing an easy sliding of the flap which does not remain permanently in contact with the edges during its sliding, but which presses perfectly thereon in the blocking position.

The water-tightness quality is a function of the type of materials used, but to fully ensure such water-tightness, the invention proposes two embodiments.

According to one embodiment, coatings that form seals are provided on the inclined planes of the blocking zones, whereas the bevelled edges of the openings of the body are advantageously obtained directly on a portion of such body.

However, at least one portion to the bevelled edges of the openings of the contact housings is preferably formed by a waterproof seal arranged on the body. The socket, in this case, advantageously includes a waterproof seal made in one piece and arranged on the body or a portion thereof, which has as many apertures as the openings of the body for the contacts, and which at least partially constitutes the bevelled edges, such that the inclined planes of the flap come to press on the ridges of such edges of the seal, in the blocking position.

Further discussing the above, the present invention is directed to and provides an electrical waterproof coupler socket comprising a body including housings for receiving contacts and openings for passage of opposing contacts of another device; contacts arranged in the housings; a protective flap translationally slidably mounted on the body, the flap comprising apertures arranged in a same number and manner as the openings of the body, a surface facing the housings, an opposing surface, and at least one blocking zone positioned on the surface of the flap facing the housings; the flap being translationally slidable between at least one blocking position where the at least one blocking zone blocks the openings of the body, and an opening position where the openings of the body and the apertures of the flap are superimposed; the at least one blocking zone comprising a plane that is inclined towards the opposing surface of the flap from front-to-rear with respect to the direction in which the flap translates towards the opening position; and the openings of the body are surrounded by bevelled edges comprising ridges, and a plane passing through the ridges is parallel to the inclined plane of the at least one blocking zone, so that the at least one blocking zone presses on the ridges in the blocking position.

Also, as discussed above, a coating can form a seal on the inclined plane of the at least one blocking zone, and the bevelled edges can comprise a portion of the body. Moreover, at least a portion of the bevelled edges can comprise a waterproof seal positioned on the body.

Additionally, there can be provided a one piece waterproof seal positioned on at least a portion of the body, the seal including as many apertures as the openings of the body, and at least partially comprising the bevelled edges comprising ridges, so that the inclined plane of the flap presses on the ridges of the seal in the blocking position.

The at least one blocking zone can comprise a plurality of blocking zones, such as two blocking zone.

BRIEF DESCRIPTION OF DRAWING

The invention will be better understood, and other characteristics will become apparent upon reading the description that follows, with reference to the annexed drawings, in which.

DETAILED DESCRIPTION OF THE PREFERRED EMBODIMENTS

Figure 1:
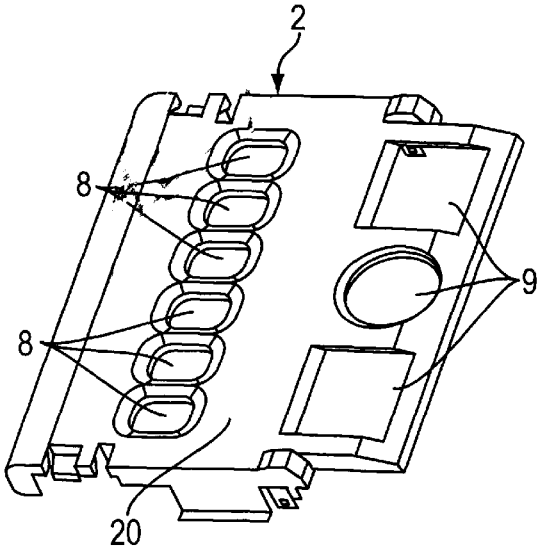
FIGS. 1 and 2 show the upper and lower surfaces, respectively, of the protective flap of a coupler socket.
Figure 2:
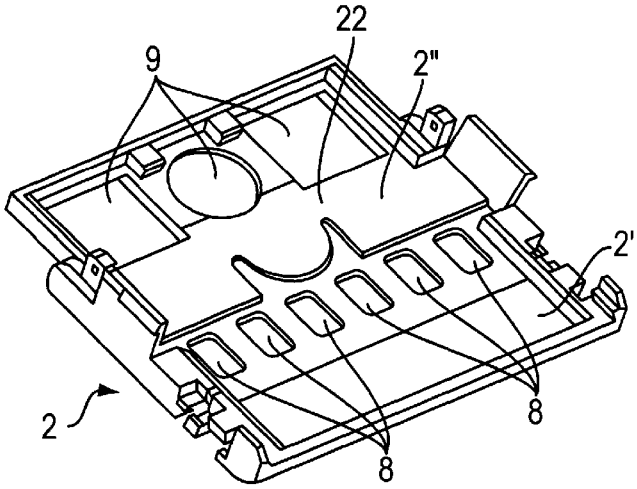
Figure 5:
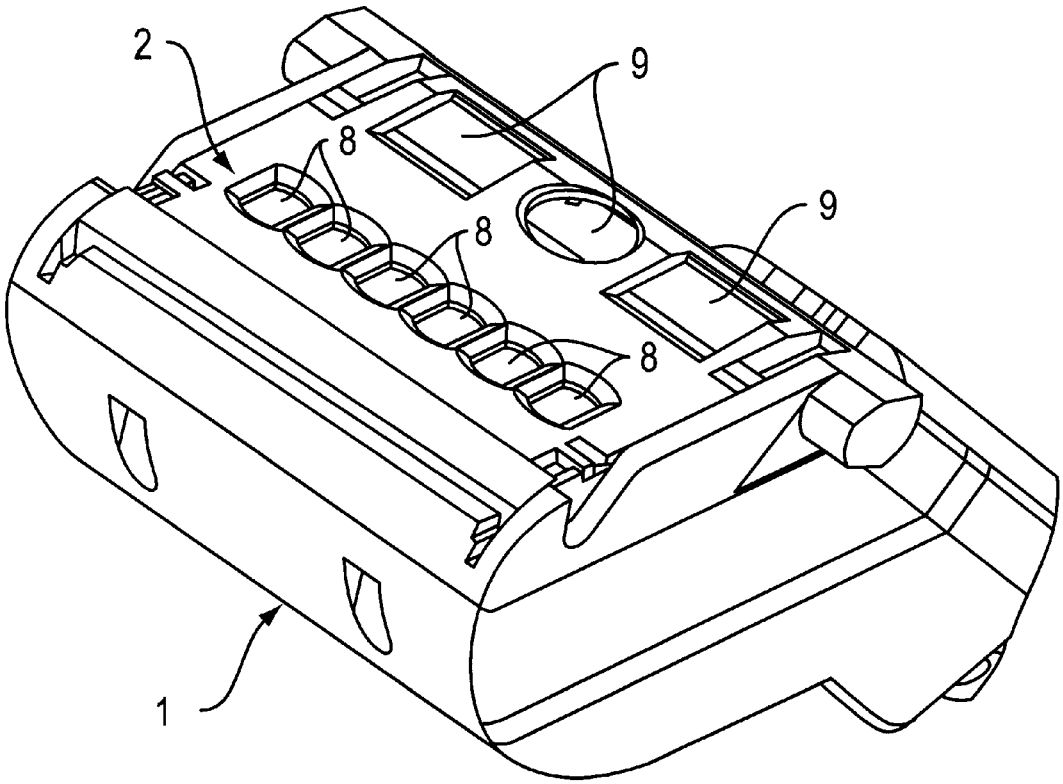
FIGS. 5, 7, and 9 show a perspective view of a coupler socket, in the blocking or resting position, in intermediate position and opening position, respectively.
Figure 7:
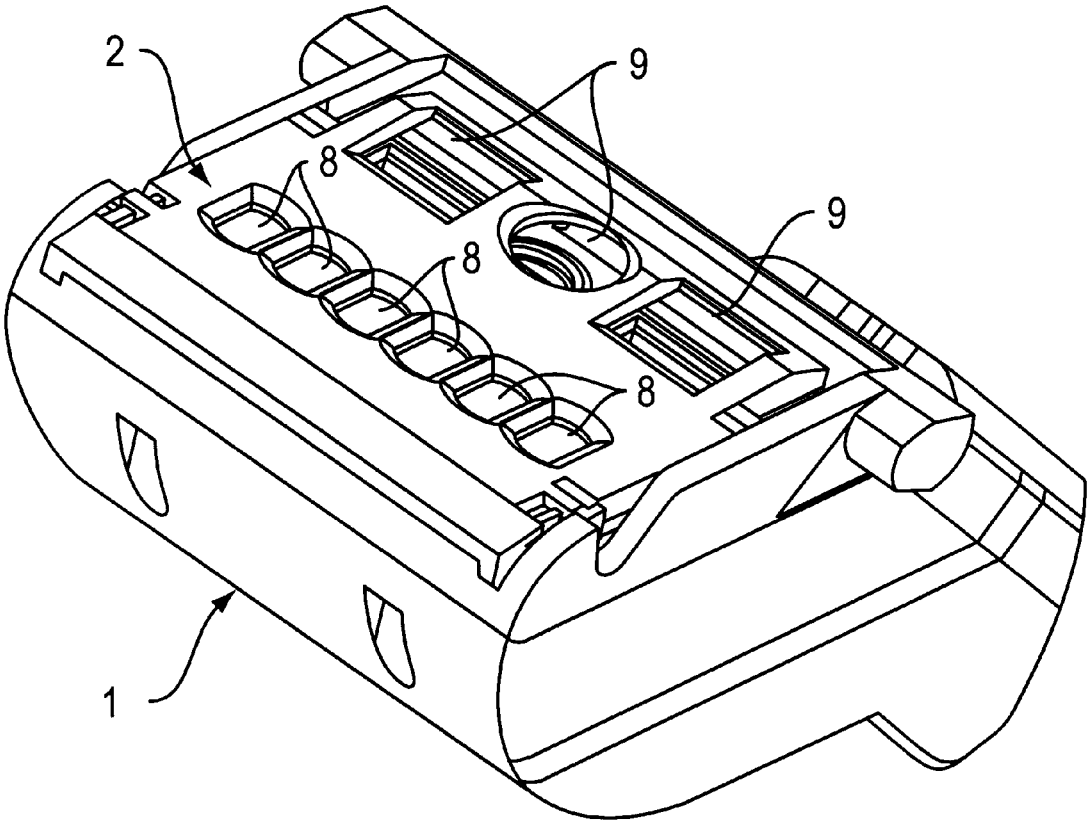
Figure 9:
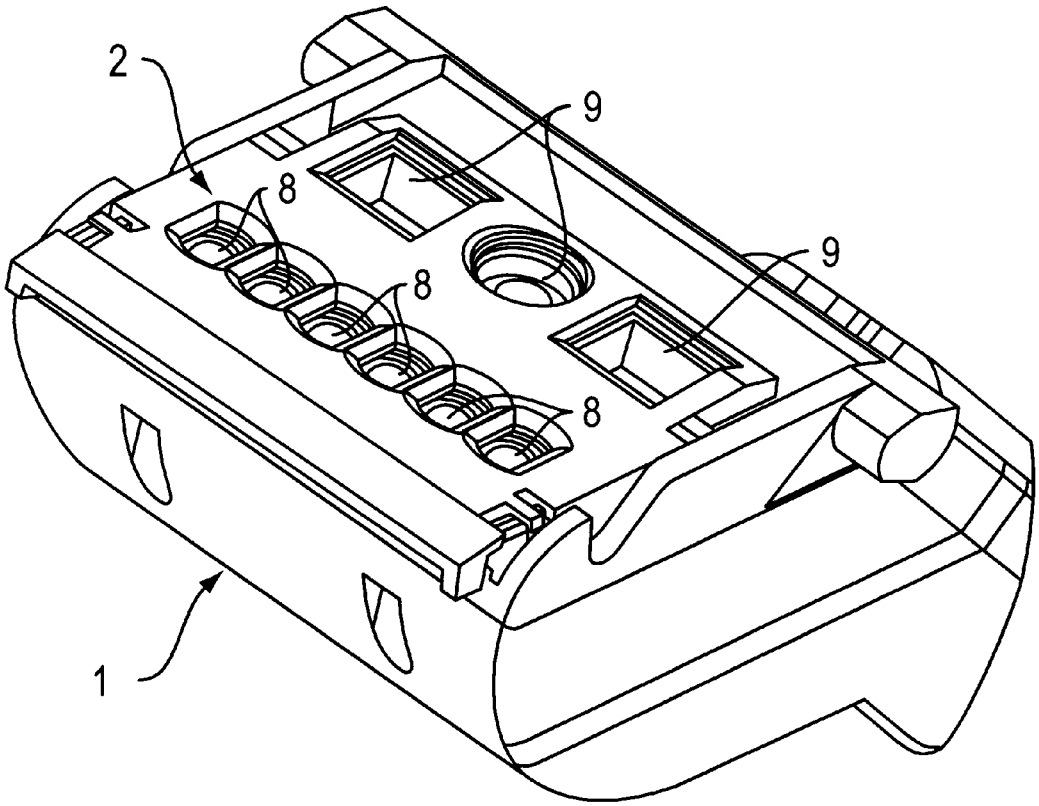

FIGS. 5, 7, and 9 show a perspective view of an electrical coupler socket provided with a body 1 on which a protective flap 2 is translationally slidably mounted, whose upper or top surface 20 and lower or bottom surface 22 are shown in FIGS. 1 and 2, respectively.

As shown in FIGS. 6, 8, and 10–13, the body 1 includes various electrical contacts such as end pressure contacts, represented here by reference numerals 3 and 4, that are arranged in appropriate housings 24 and 26 of the body 1.

The body 1 has, in its upper portion, a cap 5 provided with openings 6 and 7 arranged plumb with each housing 24 and 26 for the contacts 3 and 4, so as to allow for passage of opposing contacts of another apparatus during the coupling of the coupler socket to the apparatus, such as a connector outlet.

Figure 10:
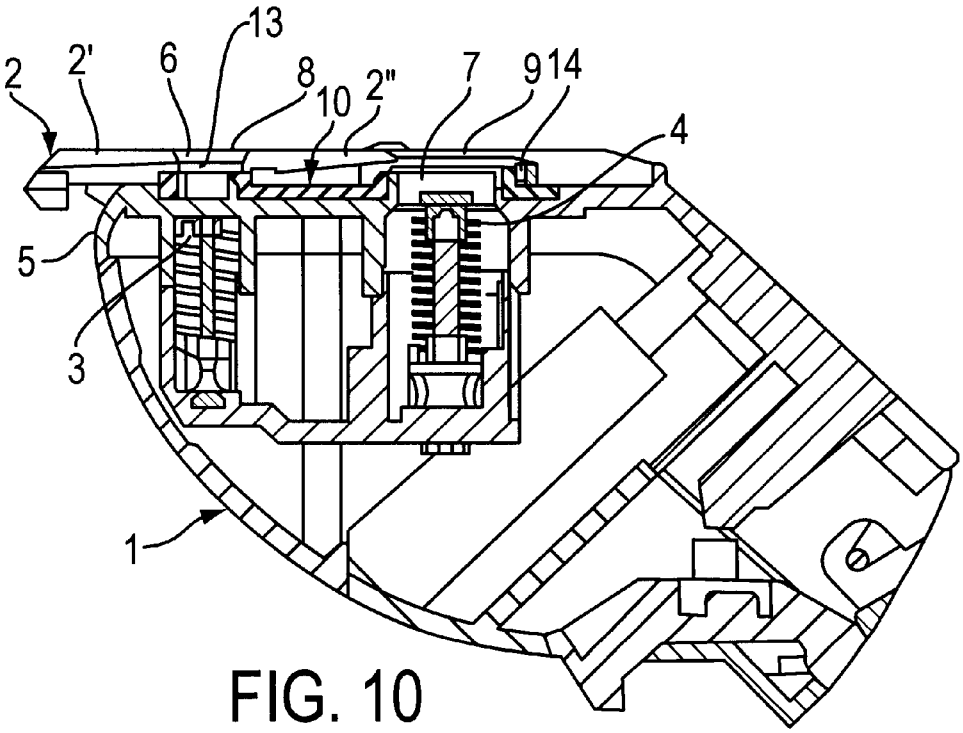
Figure 13:
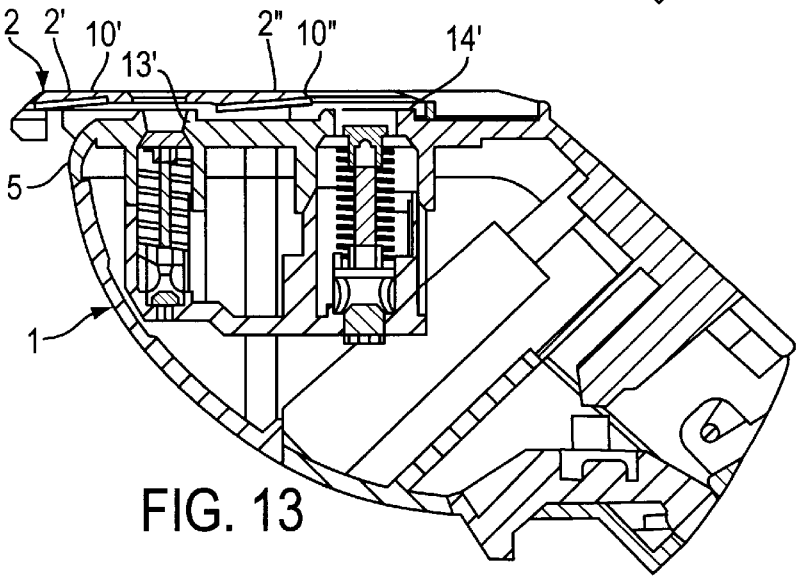

The flap 2 is also provided with as many apertures 8, 9, as the openings 6, 7, of the body 1 for the contacts 3, 4, the apertures being arranged in the same manner, such that the flap 2 can slide between at least one blocking position in which zones 2', 2", of the lower surface (FIGS. 2, 6, 8, 10) thereof block the openings 6, 7, of the cap 5 of the body 1 (FIGS. 5, 6, and 11) and an opening position (or charging position for a charging connector) where such openings 6, 7, and the apertures 8, 9, of the flap are superimposed (FIGS. 9, 10 and 13).

Figure 3:
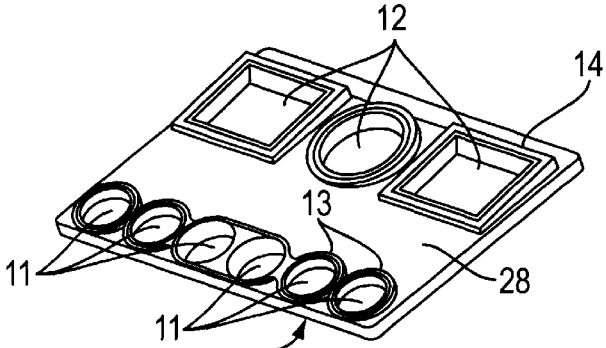
FIGS. 3 and 4 show the upper and lower surfaces, respectively, of a waterproof seal for the embodiment of FIGS. 5 to 10, according to the invention.
Figure 4:
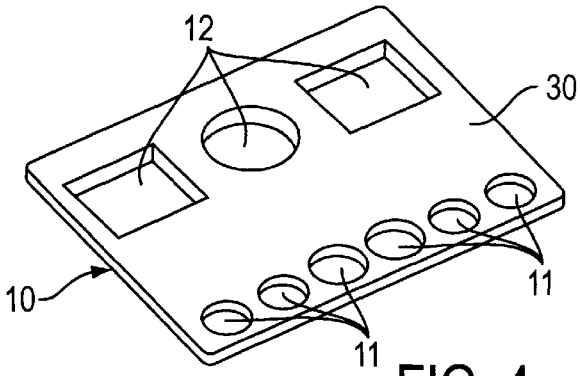

FIGS. 3 and 4 show the upper or top surface 28 and lower or bottom surface 30, respectively, of a place-shaped seal 10, for example, preferably made of silicone, having as many apertures 11, 12 as the cap 5 and the flap 2, and which are arranged in the same manner.

Figure 6:
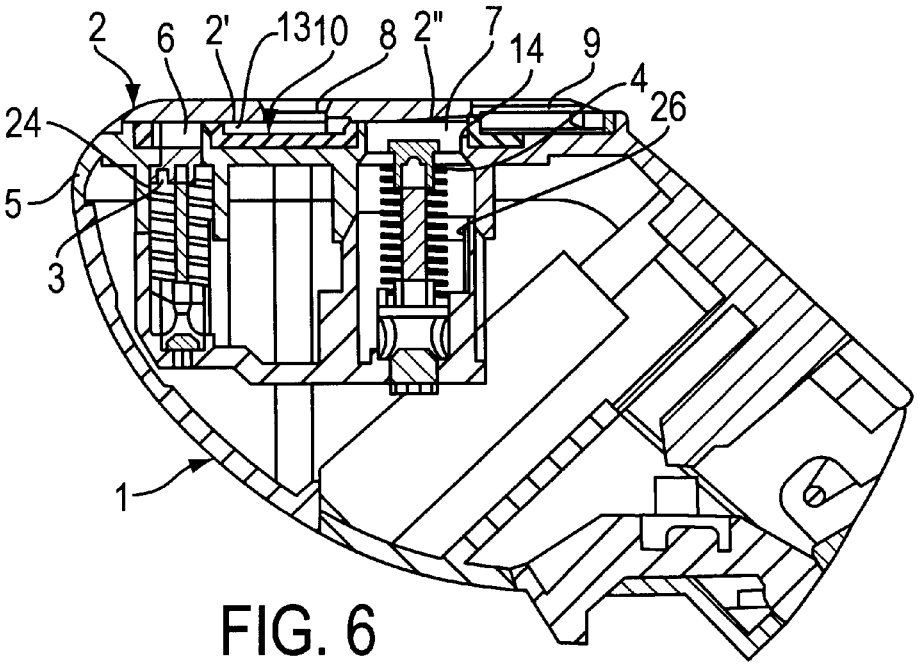
FIGS. 6, 8, and 10 are transverse cross-sections passing through two passage apertures of the protective flap.
Figure 8:
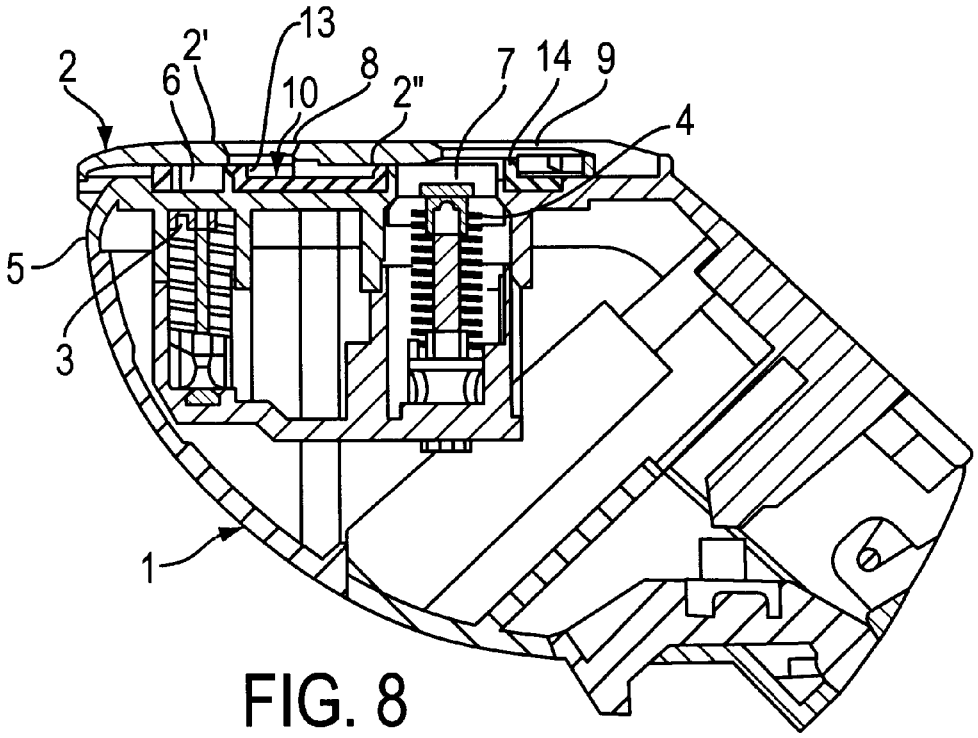

The lower surface 30 of the seal 10 (FIG. 4) is adapted to be pressed in an appropriate housing of the cap 5, as shown readily in FIGS. 6, 8 and 10, such that its upper surface 28 (FIG. 3) is turned towards the lower surface 22 (FIG. 2) of the flap 2, the apertures 11, 12, of the seal and the openings 6, 7, of the cap being arranged coaxially so that they can be aligned in the opening position of the flap.

As further shown in FIGS. 2 and 6, 10–13, the blocking zones 2', 2", of the lower surface of the flap 2 are inclined towards the upper surface of the flap 2, in the direction in which the latter slides, and from front-to-rear with respect to the direction along which the flap translates towards its opening position (i.e., by moving from FIG. 6 to FIG. 10, via FIG. 8). In other words, in FIGS. 6, 8 and 10, the blocking zones 2'and 2" will gradually become thinner from left to right.

Conversely, as shown in FIGS. 3, 6, 8 and 10, the apertures 11 and 12, of the seal 10 are provided with bevelled edges 13 and 14, with planes passing through the ridges or tips of such edges are parallel to the inclined planes of the blocking zones 2', 2" of the flap 2. Given the coaxial positions of the openings and apertures of the cap and of the seal, the edges 13 and 14 constitute actual edges on the openings of the cap, which, as shown in FIGS. 6, 8, and 10, already has edge preforms around which the edges 13, 14 of the seal become wedged.

In this way, it is clear that in the blocking position (FIGS. 5 and 6), the zones 2', 2", imperviously block the apertures 11, 12, of the seal 10 and the openings 6, 7, of the cap by perfectly pressing on the optionally ribbed edges of such apertures 11, 12, of the seal.

It is understood that the combination of the inclined plane of the zones 2', 2", and of the bevelled edges enables a waterproof blocking during the mere translatory sliding of the flap 2. It is also understood that this construction enables an easy sliding of the flap by minimizing friction, as readily shown by the intermediate position of FIGS. 7 and 8.

Indeed, the flap 2 can thus move from the blocking position of FIGS. 5, 6, to the complete opening position of FIGS. 9, 10, passing through the intermediate postilion of FIGS. 7, 8, and vice-versa, during coupling, or reciprocally separation, of the socket and the apparatus to be connected. The sliding of flap 2 can be obtained by various constructions, such as the construction as disclosed in the above-noted U.S. Pat. No. 5,478,249 and European Patent Application No. EP 0 619 628, the disclosures of which are incorporated by reference in their entirety herein.

Figure 11:
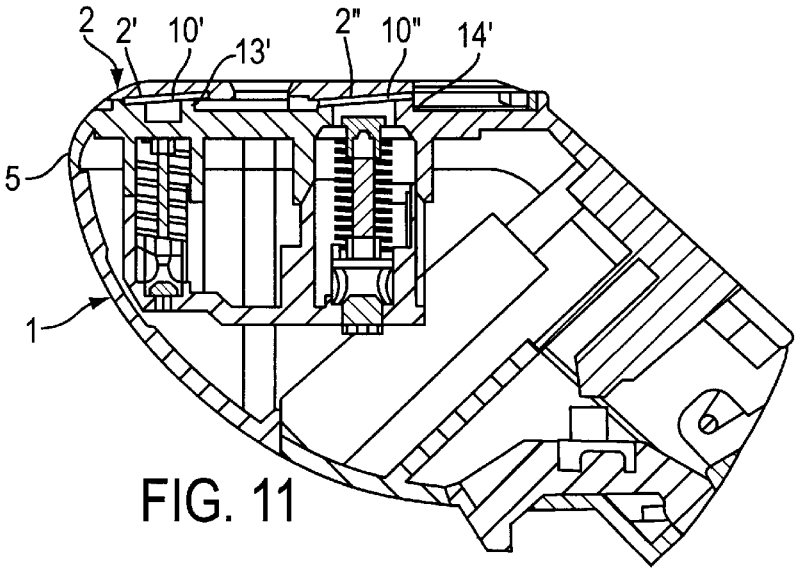
FIGS. 11, 12, and 13 are cross-sections corresponding to the cross sections 6, 8, and 10, respectively, according to another embodiment.
Figure 12:
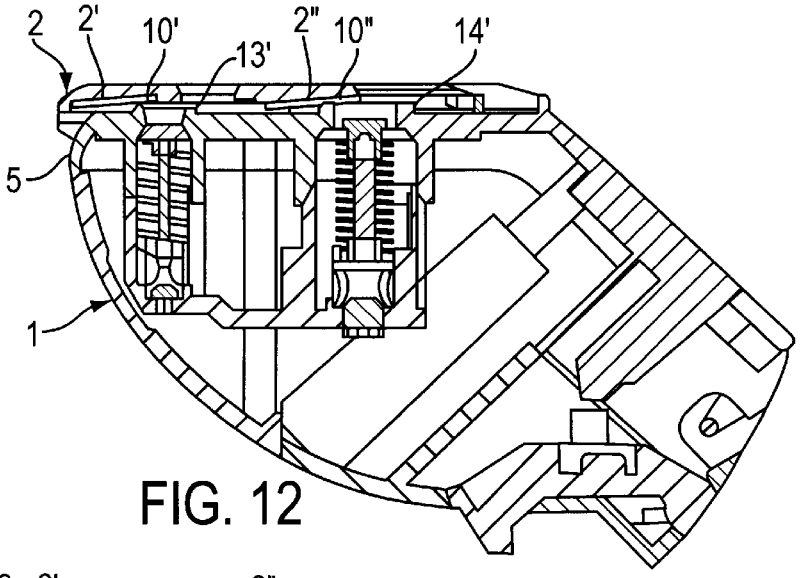

FIGS. 11–13 show a cross-sectional view of the blocking, intermediate, and opening positions, respectively, for a slightly different embodiment, but whose design and functioning are the same as for the embodiment described hereinabove.

In this embodiment, it is the cap 5 that is provided with bevelled edges 13', 14' arranged around openings 6, 7 (and integral here with such cap 5), whereas the single seal 10 is replaced by coatings that form seals 10', 10", fixed (for example by adhesion) around the zones 2', 2", of the lower surface of the flap 2.

It is understood that the result is the same, and that the functioning remains identical. Indeed, the seals 10', 10" come into contact with the ridges of the edges 13', 14', in the same manner as the zones 2', 2", come into contact with the ridges of the edges 13, 14 of the seal 10.

A mixed system could also be envisioned which includes the seal 10 of FIGS. 3, 4, 6, 8 and 10, and the seals 10', 10", of FIGS. 11–13.

The coupler socket described hereinabove, as mentioned previous, can constitute especially, but not exclusively, the coupler socket of a charging connector for an electric vehicle, the sliding of the flap 2 occurring during the coupling and uncoupling of such socket with the connector outlet arranged in the vehicle.

The instant application is based upon French Priority Patent Application No. 96.03574, filed on Mar. 22, 1996, the disclosure of which is hereby expressly incorporated by reference thereto in its entirety, and the priority of which is hereby claimed under 35 U.S.C. §119.

Although the invention has been described with reference to particular means, materials and embodiments, it is to be understood that the invention is not limited to the particulars disclosed and extends to all equivalents within the scope of the claims.

We claim:

1. Electrical waterproof coupler socket comprising:

a body including housings for receiving contacts and openings for passage of opposing contacts of another device;

contacts arranged in said housings;

a protective flap translationally slidably mounted on said body, said flap comprising apertures arranged in a same number and manner as the openings of said body, a surface facing said housings, an opposing surface, and at least one blocking zone positioned on the surface of said flap facing said housings;

said flap being translationally slidable between at least one blocking position where said at least one blocking zone blocks the openings of said body, and an opening position where said openings of the body and said apertures of the flap are superimposed;

said at least one blocking zone comprising a plane that is inclined towards the opposing surface of the flap from front-to-rear with respect to the direction in which the flap translates towards said opening position; and said openings of the body are surrounded by bevelled edges comprising ridges, and a plane passing through said ridges is parallel to the inclined plane of said at least one blocking zone, so that said at least one blocking zone presses on said ridges in the blocking position.

2. The electrical coupler socket according to claim 1, further comprising a coating forming a seal on said inclined plane of said at least one blocking zone.

3. The electrical coupler socket according to claim 2, wherein the bevelled edges comprise a portion of said body.

4. The electrical coupler socket according claim 1, wherein at least a portion of said bevelled edges comprises a waterproof seal positioned on said body.

5. The electrical coupler socket according claim 2, wherein at least a portion of said bevelled edges comprises a waterproof seal positioned on said body.

6. The electrical coupler socket according to claim 4, comprising a one piece waterproof seal positioned on at least a portion of said body, said seal including as many apertures as the openings of the body, and at least partially comprising said bevelled edges comprising ridges, so that said inclined plane of the flap presses on said ridges of said seal in said blocking position.

7. The electrical coupler socket according to claim 5, comprising a one piece waterproof seal positioned on at least a portion of said body, said seal including as many apertures as the openings of the body, and at least partially comprising said bevelled edges comprising ridges, so that said inclined plane of the flap presses on said ridges of said seal in said blocking position.

8. The electrical coupler socket according to claim 1, comprising a plurality of blocking zones.

9. The electrical coupler socket according to claim 2, comprising a plurality of blocking zones.

10. The electrical coupler socket according to claim 3, comprising a plurality of blocking zones.

11. The electrical coupler socket according to claim 4, comprising a plurality of blocking zones.

12. The electrical coupler socket according to claim 5, comprising a plurality of blocking zones.

13. The electrical coupler socket according to claim 6, comprising a plurality of blocking zones.

14. The electrical coupler socket according to claim 7, comprising a plurality of blocking zones.

15. The electrical coupler socket according to claim 8, wherein said plurality of blocking zones comprises two blocking zones.

16. The electrical coupler socket according to claim 9, wherein said plurality of blocking zones comprises two blocking zones.

17. The electrical coupler socket according to claim 10, wherein said plurality of blocking zones comprises two blocking zones.

18. The electrical coupler socket according to claim 11, wherein said plurality of blocking zones comprises two blocking zones.

19. The electrical coupler socket according to claim 12, wherein said plurality of blocking zones comprises two blocking zones.

20. The electrical coupler socket according to claim 13, wherein said plurality of blocking zones comprises two blocking zones.

* * * * *